US008016117B2

(12) United States Patent
Althouse

(10) Patent No.: US 8,016,117 B2
(45) Date of Patent: Sep. 13, 2011

(54) SYSTEM AND METHOD FOR ELIMINATING EMISSIONS FROM AN AIR CLASSIFICATION DEVICE

(75) Inventor: Michael D. Althouse, Sabetha, KS (US)

(73) Assignee: Mac Process Inc., Kansas City, MO (US)

( * ) Notice: Subject to any disclaimer, the term of this patent is extended or adjusted under 35 U.S.C. 154(b) by 134 days.

(21) Appl. No.: 12/533,062

(22) Filed: Jul. 31, 2009

(65) Prior Publication Data

US 2011/0024334 A1 Feb. 3, 2011

(51) Int. Cl.
*B07B 7/00* (2006.01)

(52) U.S. Cl. ..... 209/154; 209/44.2; 209/139.1; 209/146

(58) Field of Classification Search ..... 209/44.2, 209/139.1, 142, 146, 154; 241/19, 79.1
See application file for complete search history.

(56) References Cited

U.S. PATENT DOCUMENTS

| | | | | |
|---|---|---|---|---|
| 2,236,548 | A * | 4/1941 | Prouty | 241/41 |
| 3,608,716 | A * | 9/1971 | Rowell et al. | 209/139.1 |
| 3,878,091 | A * | 4/1975 | Hukki | 209/715 |
| 3,937,405 | A * | 2/1976 | Stephanoff | 241/39 |
| 4,784,756 | A * | 11/1988 | Ovaskainen | 209/710 |
| 5,725,102 | A * | 3/1998 | Gustavsson | 209/143 |
| 5,839,673 | A * | 11/1998 | Williams | 241/48 |
| 6,581,858 | B1 * | 6/2003 | Deklerow et al. | 241/19 |
| 7,051,880 | B1 | 5/2006 | Bills | |
| 7,347,333 | B2 * | 3/2008 | Josephs | 209/720 |

* cited by examiner

*Primary Examiner* — Joseph C Rodriguez
(74) *Attorney, Agent, or Firm* — Hovey Williams LLP

(57) ABSTRACT

An air classification device for separation of solids comprising an input system, a first solid separator system, an output system, and an emission containing system. The emission containing system employs supplemental air lines, a supplemental air source, and high-velocity air knives to create negative air pressure at any opening in the device. The negative air pressure induces air to move into the device and prevents polluted air from escaping the device at the openings.

17 Claims, 2 Drawing Sheets

SYSTEM AND METHOD FOR ELIMINATING EMISSIONS FROM AN AIR CLASSIFICATION DEVICE

BACKGROUND

1. Field

Figure 1:
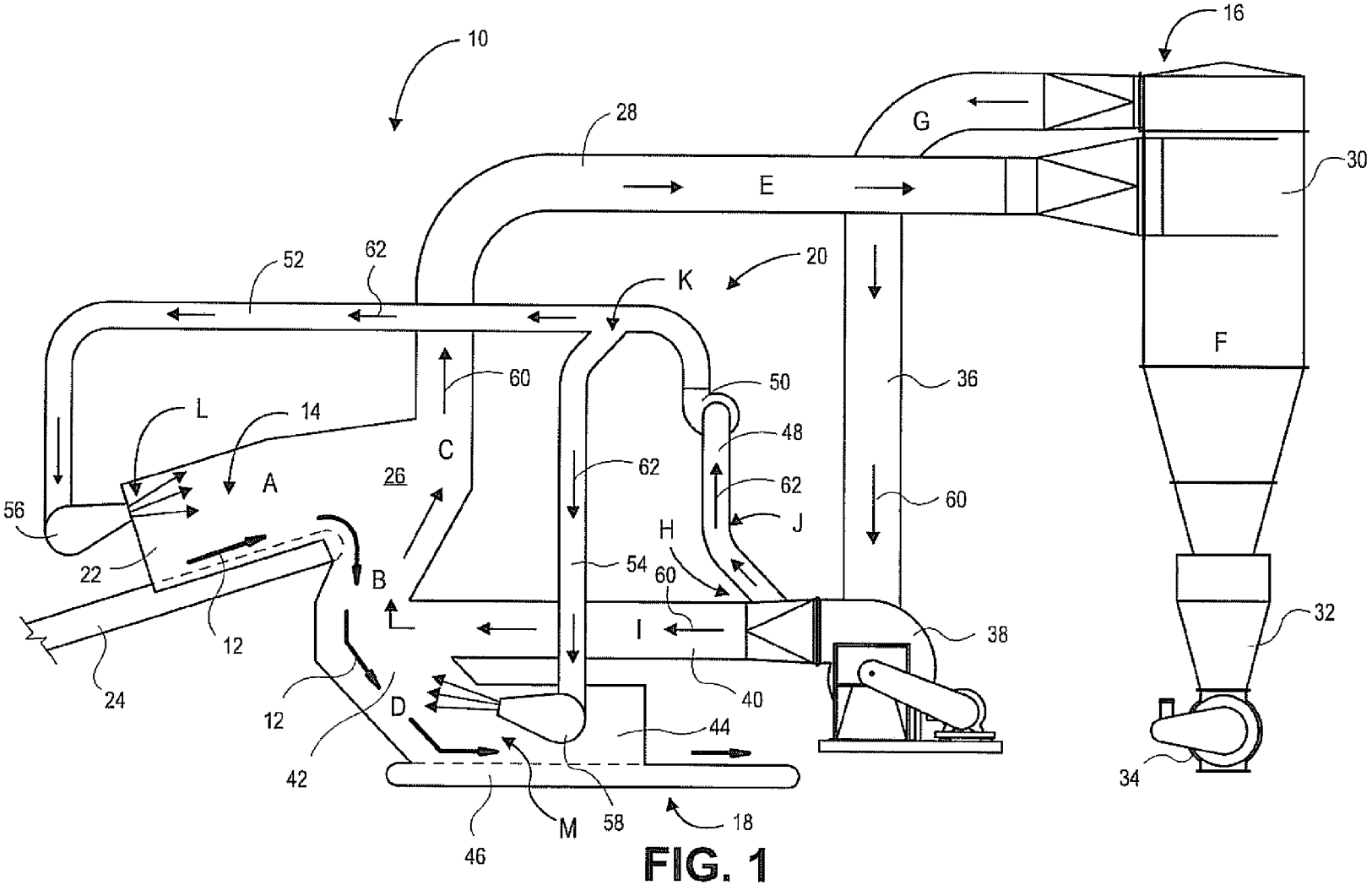

Embodiments of the present invention relate to systems and methods for eliminating emissions from an air classification device. More particularly, embodiments of the present invention relate to an air classification device having a substantially closed loop system that prevents the emission of polluted air from the device.

2. Related Art

A well known system to separate solids is an air classification device, which employs an upward air stream to separate the solids by density, shape, and weight. Air classification devices are used in numerous applications, such as grain cleaning, de-dusting of plastic pellets, and separation of solids for recycling. For example, air classification devices are often used to separate solids resulting from the shredding of automobiles, household appliances, and other machinery comprising various different types of material.

Air classification devices are a continuous process, wherein the solids to be separated are fed into and out of the device via conveyors. The air classification device separates lighter solids from heavier solids. Depending on the solids to be separated and the overall air pressure of the air classification device, a solid considered "light" for one device may be considered "heavy" for another device. Air classification devices are commonly used to separate light solids, such as carpet, seat covering, some plastics, tire cords, insulation, and road dust and dirt, from heavier materials.

In operation, the air classification device supplies an upward-moving air stream through an air classifier chamber. Concurrent with upward-moving air being supplied to the chamber, solids to be separated are provided at a general upper end of the chamber and allowed to fall through the chamber via gravity. For those solids that are light enough to be carried by the upward-moving air, the air stream and the light solids are then transported to a secondary separator, such as a cyclone separator. The light solids are then further separated, so that a substantial majority of the solids is removed from the air stream and deposited in a hopper connected to the cyclone separator. The air stream is circulated back into the air classification device to continue the process of providing an upward-moving air stream to the air classifier chamber.

Although an air classification device is theoretically a "closed loop" system, high velocity air currents inside the device can result in additional air, not required for the process, being drawn in at one point, such as an inlet, and escaping at another, such as an outlet. The escaping air is commonly polluted, which results in undesired emissions at either or both of the inlet or outlet of the air classifier.

One method of preventing the undesired emissions is to "bleed off" a portion of the air used in the classification process to maintain a negative pressure inside the air classifier. This negative pressure induces air to move into the classifier at the inlet and the outlet, which contains the emissions inside the air classifier.

A disadvantage of bleeding off the air is that it will contain many airborne pollutants. Therefore, to meet the air quality of many regulatory agencies, the air must be directed to a filter, such as a baghouse style dust collector, where the air is filtered before being exhausted to atmosphere. The exhaust is treated as an emission point and must be monitored and regulated by local air quality authorities.

Another method of preventing the undesired emissions is the use of mechanical dampers to attempt to control air from entering the air classifier. The dampers are commonly a counterweight designed to ride or float across the varying bed of solids fed into and out of the respective inlet and outlet of the air classifier. The dampers minimize the area that any air can pass through the inlet and the outlet.

A disadvantage of using mechanical dampers to limit the area in which air can enter the air classifier is that the dampers are at least partially in the array of solids being fed into and out of the air classifier. Additionally, the dampers are subject to physical damage from the varying solids transported in and out of the air classifier on in-feed and out-feed conveyors. If one of the dampers becomes bent or broken, the damper becomes ineffective, and emissions will be allowed to escape from the air classifier, or the conveyors may become blocked, which results in unscheduled down time of the air classifier. Additionally, the dampers require regular maintenance and repair. Further, maintenance of the dampers is expensive. Without proper maintenance, the dampers result in undesired emissions. Finally, and most notably, the solids on the in-feed and out-feed conveyors comprise numerous irregular shapes. The dampers float over the solids and thus, provide a poor seal, such that emissions leak out of the spaces between the damper and the irregular shapes of the solids being conveyed.

SUMMARY

Embodiments of the present invention solve the above-mentioned problems and provide a distinct advance in the art of systems and methods for eliminating undesired emissions from an air classification device. More particularly, embodiments of the invention provide a system and method employing supplemental air lines and high-velocity air knives to create a negative air pressure at openings in the air classification device to eliminate emissions from the device.

As can be appreciated, the air classification device has a system pressure provided by an air stream pressure through the device. If no air is bled off from the device, then the system pressure is generally equal to ambient pressure. Air will then naturally flow out of the device at any opening, namely an inlet and an outlet. Because it is undesirable to emit polluted air from the device at the inlet and outlet, it is necessary to contain the air inside the device. Thus, embodiments of the present invention present a substantially closed loop system that does not contain an emission point for polluted air.

In embodiments of the invention, an air classification device for separation of solids generally comprises an input system, a first solid separator system, an output system, and an emission containing system. In general, the emission containing system comprises first and second supplemental air lines fluidly connected to an air source for providing a supplemental air stream to the device. The supplemental air lines are fluidly connected to respective first and second air knives operable to provide a high-velocity air stream to a respective inlet and outlet of the air classification device. The air knives create a slight negative pressure at the inlet and the outlet that induces air to move into the air classification device and prevents polluted air from escaping the device at the inlet and the outlet.

This summary is provided to introduce a selection of concepts in a simplified form that are further described below in the detailed description. This summary is not intended to identify key features or essential features of the claimed subject matter, nor is it intended to be used to limit the scope of the claimed subject matter.

Other aspects and advantages of the present invention will be apparent from the following detailed description of the embodiments and the accompanying drawing figures.

BRIEF DESCRIPTION OF THE DRAWING FIGURES

Figure 2:
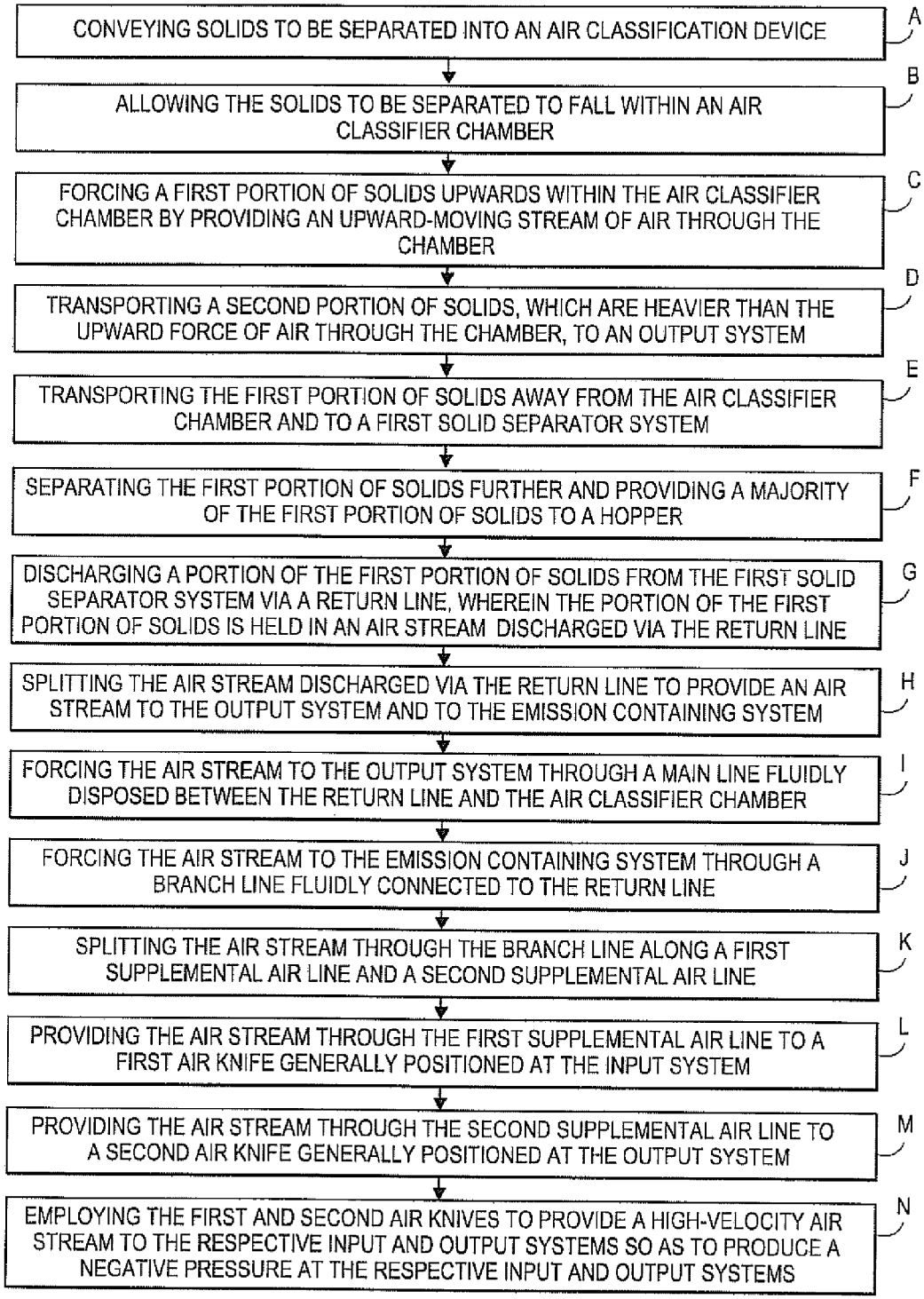

Embodiments of the present invention are described in detail below with reference to the attached drawing figures, wherein:

FIG. 1 is a schematic of an air classification device of the present invention and illustrating various systems of the device; and FIG. 2 is a flow chart of a method of containing emissions using the device of embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

FIG. 1 illustrates an air classification device 10 for separation of solids 12 generally comprising an input system 14, a first solid separator system 16 (also referred to herein as a light solid separator system), an output system 18, and an emission containing system 20.

In embodiments of the present invention, the input system 14 generally comprises an inlet 22 for inputting of solids 12 to be separated into the device 10; a first conveyor 24 for conveying said solids 12 in and through the inlet 22; an air classifier chamber 26 fluidly connected to the inlet 22 for separation of said solids 12 into a first portion of solids and a second portion of solids; and a first solid discharge line 28 fluidly connected to the air classifier chamber 26 for discharging the first portion of solids.

In embodiments of the present invention, the first solid separator system 16 generally comprises a cyclone separator 30 fluidly connected to the first solid discharge line 28 and operable to receive the discharged first portion of solids from the first solid discharge line 28; a hopper 32 in which to receive at least a portion of the first portion of solids; an airlock 34; a return line 36 fluidly disposed between the first solid discharge line 28 and the cyclone separator 30; and a first, primary fan 38 for supplying a stream of air 60 to either or both of the output system 18 and the emission containing system 20.

In embodiments of the present invention, the output system 18 generally comprises a main line 40 fluidly connected to the first, primary fan 38; a second solid discharge line 42 fluidly connected to the main line 40 and the air classifier chamber 26 for discharging the second portion of solids; an outlet 44 fluidly connected to the second solid discharge line 42 for outputting of the second portion of solids from the device 10; and a second conveyor 46 for conveying said second portion of solids through and out of the outlet 44.

In embodiments of the present invention, the emission containing system 20 generally comprises a branch line 48 fluidly connected to the return line 36; a second, booster fan 50 fluidly connected to the branch line 48 and operable to produce a supplemental air stream 62 to the device 10; a first supplemental air line 52 fluidly disposed between the second fan 50 and the input system 14; a second supplemental air line 54 fluidly disposed between the second fan 50 and the output system 18; a first air knife 56 fluidly connected to the first supplemental air line 52 and positioned to present a high-velocity air stream to the input system 14; and a second air knife 58 fluidly connected to the second supplemental air line 54 and positioned to present a high-velocity air stream to the output system 18.

In more detail, the solids 12 to be separated are conveyed into the air classification device 10 via the first conveyor 24, as illustrated at step A in FIGS. 1 and 2. The first conveyor 24 is any suitable mechanism for conveying or transporting the solids 12 in and through the inlet 22 of the device 10, such as a pulley and belt system (not shown) or screw system (not shown). The inlet 22 of the device 10 includes a cover that at least partially surrounds an upper portion of an end of the first conveyor 24, as illustrated in FIG. 1. The cover is preferably configured to allow any solids 12 located on the first conveyor 24 to pass through the inlet 22.

The inlet 22 is fluidly connected to the air classifier chamber 26. In embodiments of the present invention, the inlet 22 and the air classifier chamber 26 are generally a continuous structure, as illustrated in FIG. 1, such that the solids 12 pass through the inlet 22 and directly to the air classifier chamber 26. The inlet 22 preferably has a width and a height to accommodate movement of the solids 12 therethrough. As can be appreciated, the air classification device 10 can be used with a wide variety of solids to be separated, so the dimensions for a particular air classification device 10, and therefore, for the inlet 22, will vary depending on an aggregate size of the solids to be separated.

As is known in the art, the air classifier chamber 26 is a large, open area through which the solids 12 fall via gravity. As such, the end of the conveyor 24 terminates at a point within or proximal to the air classifier chamber 26. The solids 12 to be separated then begin to fall within the air classifier chamber 26, as illustrated at step B in FIGS. 1 and 2. Simultaneous with the solids 12 falling within the chamber 26, a stream of air is pushed upwards through the chamber 26. The air stream 60 is of sufficient pressure to force a portion of the solids 12 correlating to "light solids," namely the first portion of solids, to move upwards to and through the first solid discharge line 28, as illustrated at step C in FIGS. 1 and 2. However, for another portion of the solids 12, namely the second portion of solids, the force of the air stream 60 will be insufficient to transport the solids to the first solid discharge line 28 because a weight of the solids will be greater than the upward force of the air stream 60. Thus, for the second portion of solids, which correlate to "heavy solids," the solids will fall in and through the second solid discharge line 42, as further explained below and as illustrated at step D in FIGS. 1 and 2. As can be appreciated, a particular weight of a solid and whether the solid correlates to a "light solid" or a "heavy solid" is dependent on a size of the air classification device 10 and the pressure of the air stream 60 pushed upwards through the chamber 26. Therefore, a "light solid" for one air classification device may be considered a "heavy solid" in another air classification device, depending on the desired parameters of the device 10.

As noted above, the first portion of solids, corresponding to the "light solids," is discharged from the air classifier chamber 26 and transported to and through the first solid discharge line 28, as illustrated at step E in FIGS. 1 and 2. The first line 28 is fluidly connected to and disposed between the air classifier chamber 26 and the first solid separator system 16, as illustrated in FIG. 1, such that the air stream 60 flows upwardly through the air classifier chamber 26, through the first solid discharge line 28, and to the first solid separator system 16.

The first solid discharge line 28 generally comprises a conduit or duct through which the air stream 60 and the first portion of solids may pass therethrough. Similarly, the other lines described herein generally comprise conduits or ducts for passage of either or both of an air stream and solids therethrough. In embodiments of the present invention, the lines are formed of aluminum, stainless steel, plastic, or fabricated carbon, although it may be formed of any suitable material that can retain the air stream 60 and solids 12.

The first solid separator system 16 is operable to separate further the first portion of solids, as illustrated at step F in FIGS. 1 and 2. Embodiments of the present invention employ the cyclone separator 30 to separate the first portion of solids. The cyclone separator 30 may be a single or a multiple cyclone separator. In alternative embodiments of the present invention, the first solid separator system 16 may be a settling system, a baffle system, a baghouse filter, or any other suitable separator or filter system.

As is known in the art, the cyclone separator 30 separates the first portion of solids via centrifugal force. The air stream, which comprises the first portion of solids, is spun inside the separator. A majority of the first portion of solids strikes an inner wall (not shown) of the cyclone separator 30 and falls via gravity into the hopper 32, which receives the majority portion of the first portion of solids. The airlock 34 prevents air from escaping the hopper 32, except as desired and in a controlled manner.

The lighter or finer portion of the first portion of solids in the air stream is discharged from the cyclone separator 30 via the return line 36, as illustrated at step G in FIGS. 1 and 2. The lighter or finer portion comprises primarily dust and dirt, which is readily transported within the air stream 60. Thus, the air stream 60 discharged from the separator 30 via the return line 36 will contain some pollutants, the amount of which will depend on the efficiency of the cyclone separator 30.

The air stream 60 exits the cyclone separator 30 via the return line 36 and is transported to the first, primary fan 38. The primary fan 38 is an air source that increases the force or pressure of the air stream 60 exiting the primary fan 38. The air stream 60 is then split to provide air streams to the output system 18 and to the emission containing system 20, as further described below and as illustrated at step H in FIGS. 1 and 2.

The air stream to the output system 18, hereinafter referred to as the output air stream 60 and illustrated at step I in FIGS. 1 and 2, is provided to the output system 18 via the main line 401 as illustrated in FIG. 1. The main line 40 is fluidly connected to the second solid discharge line 42, which, as noted above, is fluidly connected to the air classifier chamber 26. As the output air stream 60 exits the primary fan 38, the output air stream 60 is provided along the main line 40, to the second solid discharge line 42, and to the air classifier chamber 26.

As described above, the output air stream 60 provided to the air classifier chamber 26 has a sufficient upward force to separate the solids falling into the air classifier chamber 26 via the input system 14. The second portion of solids corresponding to the "heavy solids," which are heavier than the force of the upward-moving air stream, fall into the second solid discharge line 42, as illustrated at step D in FIG. 1. The second portion of solids then falls via gravity onto the second conveyor 46, which conveys the solids through and out of the outlet 44.

Similar to the first conveyor 24, the second conveyor 46 is any suitable mechanism for conveying or transporting the second portion of solids in and through the outlet 44 of the device 10, such as a pulley and belt system (not shown) or screw system (not shown). Additionally, the outlet 44 of the device 10 includes a cover that at least partially surrounds an upper portion of the second conveyor 46, as illustrated in FIG. 1. The cover is preferably a continuous structure with the second solid discharge line 42 and the air classifier chamber 26.

As noted above, the air stream exiting the first, primary fan 38 is split along the output system 18 and the emission containing system 20. With respect to the air stream to the emission containing system 20, hereinafter referred to as the supplemental air stream 62, it is first provided along the branch line 48, as illustrated at step J in FIGS. 1 and 2. In embodiments of the present invention, the branch line 48 is connected to and branches off from the main line 40 immediately adjacent to or proximal from the primary fan 38. In alternative embodiments of the present invention, the branch line 48 is connected to the primary fan 38, such that the air stream 60 is split as it exits the primary fan 38. In even further alternative embodiments of the present invention, the branch line 48 and/or the first and second supplemental air lines 52,54 are fluidly connected to an air source, such as the second, booster fan 50, for providing the supplemental air stream 60 to the air classifier chamber 26.

In more detail, the supplemental air stream 62 through the branch line 48 encounters the second, booster fan 50 downstream. Similar to the first, primary fan 38, the second, booster fan 50 is operable to increase the force or pressure of the supplemental air stream 62 exiting the fan 50. The supplemental air stream 62 is then again split along the first supplemental air line 52 and the second supplemental air line 54, as illustrated at step K in FIGS. 1 and 2. The air stream along the first supplemental air line 52 is provided to the first air knife 56, as illustrated at step L in FIGS. 1 and 2. Similarly, the air stream along the second supplemental air line 54 is provided to the second air knife 58, as illustrated at step M in FIGS. 1 and 2. In embodiments of the present invention, the supplemental air stream 62 is split generally equally along the first and second supplemental air lines 52,54.

The first and second air knives 56,58 of embodiments of the present invention are operable to provide a high-velocity, high-pressure laminar air stream to the respective inlet 22 and outlet 44, as illustrated at step N in FIG. 2. Each air knife includes a plenum (not shown) having a plurality of apertures (not shown) through which the air streams from the respective first and second supplemental air lines 52,54 are provided therethrough. Because the air streams include a force and a pressure, the air through the air knives 56,58 is necessarily pressurized. In alternative embodiments of the present invention, one or both of the air knives 56,58 may be provided with a supplemental air source (not shown) to increase the air pressure through the knives 56,58. In even further alternative embodiments of the present invention, more than one air knife is used at each of the inlet 22 and outlet 44. Although the parameters for the particular air knife employed will vary depending on the size of the air classification device 10, air knives 56,58 used in the device 10 of embodiments of the present invention will have a preferable exit air velocity of approximately 2,000-10,000 ft/min, more preferably approximately 3,000-8,000 ft/min, and most preferably approximately 5,000-7,000 ft/min. Embodiments of the present invention utilize an air knife with an exit air velocity of approximately 6,000 ft/min.

As can be appreciated, the inlet 22 and the outlet 44 are the only two locations on the air classification device 10 where air can "escape" the device 10 in an uncontrolled manner. Because the air that can escape is laden with pollutants, it is desirable to prevent the air from escaping to atmosphere via the inlet 22 and the outlet 44. To accomplish this, embodiments of the present invention employ the air knives 56,58 at the inlet 22 and the outlet 44. The high-velocity laminar flow of the air knives 56,58 creates a negative pressure at the inlet 22 and the outlet 44, and specifically, proximal to the respective air knife. The negative pressure of the device 10 at the inlet 22 and the outlet 44 prevents air from escaping the device 10.

In more detail, the air stream exiting the air knives 56,58 is of such a high velocity that the air pressure proximal to each air knife is decreased. To obtain an equilibrium in pressure between the air classification device 10 and atmosphere, a negative air pressure proximal to the air knife will induce air to enter the device 10, and, notably, prevent air from escaping the device 10. The air knives 56,58 thus create a slight Venturi effect, as a negative air pressure is created via use of the high-velocity air knives 56,58.

As is known, a Venturi effect is commonly experienced when a liquid or gas flowing through a tube of a first diameter suddenly encounters a second diameter section of tube, wherein the second diameter is less than the first diameter. The sudden flow of the liquid or gas through the constricted tube increases the velocity of the liquid or gas and consequently, decreases the pressure through the constricted tube.

In a similar manner, the high-velocity air knives 56,58 increase the velocity of air through the respective inlet 22 and outlet 44. Because the air velocity is increased, the pressure at the inlet 22 and outlet 44 is decreased below atmospheric pressure immediately outside the respective inlet 22 and outlet 44. This decrease in pressure at the inlet 22 and the outlet 44 induces air to move into the air classification device 10 and prevents the emission of polluted air from the device 10.

Thus, embodiments of the present invention present a substantially closed loop system that does not contain an emission point for polluted air. The air provided to the inlet 22 and the outlet 44 via the first and second supplemental air lines 52,54 is polluted. However, because this polluted air is provided back to the device 10, as opposed to being bled off from the device 10, there is no requirement for an external filter for receipt of polluted, bled air. Moreover, because the air provided to the device 10 via the supplemental air lines 52,54 is cycled through the cyclone separator 30, the air is not so polluted that it will unduly harm the second, booster fan 50, any ductwork associated with the device 10, or the air knives 56,58. Further, because the air classification device 10 of embodiments of the present invention emits substantially zero emissions, no air permit is required to install the device 10.

As can be appreciated, the air classification device 10 of embodiments of the present invention is comprised of various lines fluidly interconnected. Reference herein to the method of separating solids 12 using the device 10 and to particular areas within the device 10 that perform a particular step of the method is not intended to be limiting. For example, the separation of the solids 12 into the first and second portions of solids is described as occurring at the air classifier chamber 26. The second portion of solids then falls via gravity into the second solid discharge line 42. It is to be understood that because the air classifier chamber 26 and the second solid discharge line 42 are fluidly interconnected, and in fact, in embodiments of the present invention, are a continuous structure, a description of the separation of the solids 12 occurring at the air classifier chamber 26 should not exclude separation of solids that occur at, for example, the second solid discharge line 42.

Although the invention has been described with reference to the embodiments illustrated in the attached drawing figures, it is noted that equivalents may be employed and substitutions made herein without departing from the scope of the invention as recited in the claims. For example, in alternative embodiments of the present invention, additional supplemental air lines and air knives could be employed depending on a number of openings in the air classification device 10. Additionally, the air knives 56,58 of embodiments of the present invention could be placed immediately interior the respective inlet 22 and outlet 44, as illustrated at the inlet 22 in FIG. 1, spaced a distance within the respective inlet 22 or outlet 44, as illustrated at the outlet 44 in FIG. 1, or positioned at any location sufficient to produce the negative air pressure.

Having thus described various embodiments of the invention, what is claimed as new and desired to be protected by Letters Patent includes the following:

1. An air classification device for separation of solids comprising:

an inlet through which the solids are provided to the air classification device;

an air classification chamber in which the solids are separated into a first portion of solids and a second portion of solids based on a weight of the solids;

a first air source for providing an upward-moving air stream through the air classification chamber to assist in the separation of the solids;

a separator system through which at least a portion of the first portion of solids are discharged from the air classification device;

a return line fluidly connected to the separator system for receipt of air discharged from the separator system therethrough;

an outlet through which the second portion of solids are discharged from the air classification device;

a first supplemental air line downstream of the separator system and in fluid communication with the return line;

a second supplemental air line downstream of the separator system and in fluid communication with the return line;

a first air knife fluidly connected to the first supplemental air line and positioned to present a high-velocity air stream into the inlet; and a second air knife fluidly connected to the second supplemental air line and positioned to present a high-velocity air stream into the outlet.

2. The air classification device of claim 1, wherein the first portion of solids corresponds to light solids, and the second portion of solids corresponds to heavy solids.

3. The air classification device of claim 1, wherein the separator system is a cyclone separator operable to separate further the first portion of solids.

4. The air classification device of claim 1, further including a first conveyor positioned at the inlet and operable to transport the solids to the air classification device, and a second conveyor positioned at the outlet and operable to discharge the second portion of solids from the air classification device.

5. The air classification device of claim 1, wherein the high-velocity air stream produced by the first and second air knives is approximately 5,000-7,000 ft/min.

6. An air classification device for separation of solids comprising:

an inlet for inputting of solids to be separated into the device;

an air classifier chamber fluidly connected to the inlet for separation of said solids into a first portion of solids and a second portion of solids;

a first solid discharge line fluidly connected to the air classifier chamber for discharging the first portion of solids;

a separator for separating the first portion of solids, said separator fluidly connected to the first solid discharge line and operable to receive the first portion of solids from the first solid discharge line;

a second solid discharge line fluidly connected to the air classifier chamber for discharging the second portion of solids;

an outlet fluidly connected to the second solid discharge line for outputting of the second portion of solids from the air classification device;

a return line fluidly disposed between the first solid discharge line and the cyclone separator;

a first supplemental air line downstream of the separator and in fluid communication with the return line;

a second supplemental air line downstream of the separator and in fluid communication with the return line;

a fan disposed between the return line and the first and second supplemental air lines and operable to force an air stream through the supplemental air lines;

a first air knife fluidly connected to the first supplemental air line and positioned to present a high-velocity air stream into the inlet; and a second air knife fluidly connected to the second branch line and positioned to present a high-velocity air stream into the outlet.

7. The air classification device of claim 6, wherein the fan is a first fan, said air classification device further including a second fan disposed between the first fan and the first and second supplemental air lines.

8. The air classification device of claim 6, wherein the first portion of solids corresponds to light solids, and the second portion of solids corresponds to heavy solids.

9. The air classification device of claim 6, wherein the first air knife is positioned internal to the inlet.

10. The air classification device of claim 6, wherein the second air knife is positioned adjacent the outlet.

11. The air classification device of claim 6, wherein the second air knife is positioned internal the outlet.

12. The air classification device of claim 6, wherein the separator is operable to separate a majority of the solids from the first portion of solids and deliver an air stream having pollutants to the return line.

13. A method of eliminating emissions from an air classification device used to separate solids, the method comprising the steps of:

(a) conveying solids to be separated into the air classification device via an inlet;

(b) employing an air classifier chamber to separate the solids into a first portion of solids and a second portion of solids;

(c) transporting the first portion of solids to a first solid separator system;

(d) transporting the second portion of solids to an outlet;

(e) separating the first portion of solids via the first solid separator system;

(f) discharging a portion of the first portion of solids from the first solid separator system via a return line, wherein the portion of the first portion of solids is held in an air stream discharged via the return line;

(g) splitting the air stream discharged via the return line to provide an air stream to the output system and to an emission containing system;

(h) forcing the air stream to the output system through a main line fluidly disposed between the return line and the air classifier chamber;

(i) forcing the air stream to the emission containing system through a branch line fluidly connected to the return line;

(j) splitting the air stream through the branch line along a first supplemental air line and a second supplemental air line;

(k) providing the air stream through the first supplemental air line to a first air knife generally positioned at the inlet;

(l) providing the air stream through the second supplemental air line to a second air knife generally positioned at the outlet; and (m) employing the first and second air knives to provide a high-velocity air stream to the respective inlet and outlet so as to produce a negative pressure at the respective inlet and outlet.

14. The method of claim 13, wherein step (b) further comprises the steps of allowing the solids to be separated to fall within an air classifier chamber; and forcing a first portion of solids upwards within the air classifier chamber by providing an upward-moving stream of air through the chamber.

15. The method of claim 13, wherein the high-velocity air stream produced by the first and second air knives is approximately 5,000-7,000 ft/min.

16. A method of eliminating emissions from an air classification device used to separate solids, the method comprising the steps of:

(a) inputting solids to be separated into the air classification device via an inlet;

(b) separating the solids into a first portion of solids and a second portion of solids via an air classifier chamber;

(c) transporting the first portion of solids to a first solid separator system;

(d) transporting the second portion of solids to an outlet;

(e) separating the first portion of solids via the first solid separator system;

(f) discharging a polluted air stream from the first solid separator system;

(g) splitting the polluted air stream discharged from the first solid separator system to provide a first air stream to the inlet and a second air stream to the outlet, wherein the first air stream to the inlet is provided along a first air line, and the second air stream to the outlet is provided along a second air line;

(h) providing the first air stream through the first air line to a first air knife generally positioned at the inlet;

(i) providing the second air stream through the second air line to a second air knife generally positioned at the outlet; and (j) employing the first and second air knives to provide a high-velocity air stream to the respective inlet and outlet so as to produce a negative pressure at the respective inlet and outlet.

17. A method of eliminating emissions from an air classification device used to separate solids, the method comprising the steps of:

(a) providing an input system for inputting solids to be separated into the air classification device via an inlet;

(b) providing an air classifier chamber for separating the solids into a first portion of solids and a second portion of solids;

(c) providing a first solid discharge line for transporting the first portion of solids to a first solid separator system;

(d) providing a second solid discharge line for transporting the second portion of solids to an outlet;

(e) providing a first air line downstream of the first solid separator system and for receipt of at least a first portion of a polluted air stream from the separator system, wherein the first air line is fluidly connected to the inlet;

(f) providing a second air line downstream of the first solid separator system and for receipt of at least a second portion of a polluted air stream from the separator system, wherein the second air line is fluidly connected to the outlet;

(g) providing a first air knife generally positioned at the inlet for receipt of the first portion of a polluted air stream transported through the first air line;

(h) providing a second air knife generally positioned at the outlet for receipt of the second portion of a polluted air stream transported through the second air line, wherein the first and second air knives provide a high-velocity air stream to the respective inlet and outlet so as to produce a negative pressure at the respective inlet and outlet.

* * * * *